US005200778A

United States Patent [19]

Ito

[11] Patent Number: 5,200,778

[45] Date of Patent: Apr. 6, 1993

[54] COPYING APPARATUS HAVING A MEMORY FOR STORING SELECTED COPYING CONDITIONS

[75] Inventor: Masazumi Ito, Osaka, Japan

[73] Assignee: Minolta Camera Kabushiki Kaisha, Osaka, Japan

[21] Appl. No.: 810,538

[22] Filed: Dec. 19, 1991

Related U.S. Application Data

[63] Continuation of Ser. No. 291,212, Dec. 28, 1988, abandoned.

[30] Foreign Application Priority Data

Dec. 29, 1987 [JP] Japan ..... 62-335580

[51] Int. Cl.[5] ..... G03G 21/00

[52] U.S. Cl. ..... 355/204

[58] Field of Search ..... 355/204, 206, 208

[56] References Cited

U.S. PATENT DOCUMENTS

| | | | |
|---|---|---|---|
| 4,161,277 | 7/1979 | Steiner | 235/304 |
| 4,222,660 | 9/1980 | Furuichi et al. | 355/311 |
| 4,275,958 | 6/1981 | Tachika et al. | 355/313 |
| 4,453,821 | 6/1984 | Smith | 355/204 X |
| 4,568,173 | 2/1986 | Abuyama | 355/243 |
| 4,652,113 | 3/1987 | Watanabe | 355/326 |
| 4,668,075 | 5/1987 | Shigemura et al. | 355/206 |
| 4,693,459 | 9/1987 | Shimoda et al. | 271/9 |
| 4,693,590 | 9/1987 | Umeda | 355/313 |
| 4,933,720 | 6/1990 | Takano et al. | 355/209 |

FOREIGN PATENT DOCUMENTS

| | | |
|---|---|---|
| 56-66865 | 6/1981 | Japan . |
| 58-7652 | 1/1983 | Japan . |
| 59-222854 | 12/1984 | Japan . |
| 60-37567 | 2/1985 | Japan . |
| 60-93467 | 5/1985 | Japan . |
| 61-32868 | 2/1986 | Japan . |
| 61-62060 | 3/1986 | Japan . |

OTHER PUBLICATIONS

D. J. Conly et al, "Automatic Restoration of Interrupted Job", *IBM Technical Disclosure Bulletin*, vol. 25, No. 11A, Apr. 1983, pp. 5630–5632.

M. J. Miller, "Program Control of Job Control Information Entry for COpier", *IBM Technical Disclosure Bulletin*, vol. 18, No. 10, Mar. 1976, pp. 3162 and 3163.

*Primary Examiner*—Fred L. Braun

*Attorney, Agent, or Firm*—Burns, Doane, Swecker & Mathis

[57] ABSTRACT

A copy apparatus in which a plurality of copying elements cooperate to form images includes an input apparatus for inputting copying conditions of a plurality of prescribed items necessary for determining an image forming mode; a first control apparatus for controlling the plurality of elements to carry out image formation under the inputted copying conditions; a memory for storing the plurality of copying conditions inputted by the input apparatus; a memory control apparatus for storing in the memory those of the plurality of copying conditions for the prescribed items which are for desired items; a calling apparatus for calling the copying conditions for the desired items stored in the memory; and a second control apparatus for controlling the plurality of elements such that image formation is carried out under the called conditions for the desired items and under the inputted conditions for the items other than the desired items. A method is also claimed.

5 Claims, 12 Drawing Sheets

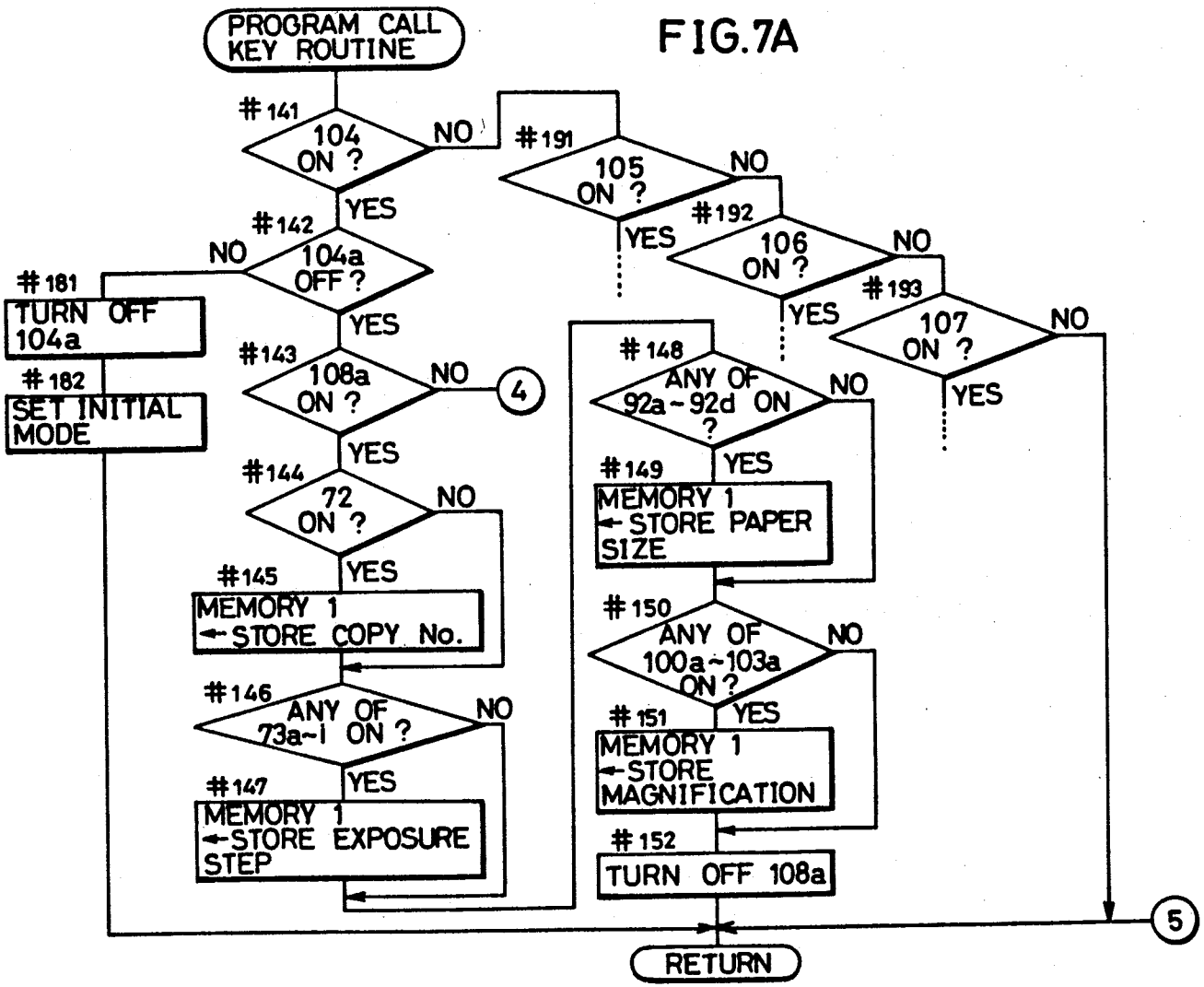
FIG.7A
FIG.7
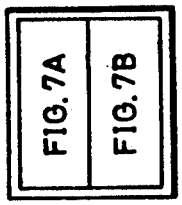

COPYING APPARATUS HAVING A MEMORY FOR STORING SELECTED COPYING CONDITIONS

This application is a continuation, of application Ser. No. 07/291,212, filed Dec. 28, 1988, now abandoned.

BACKGROUND OF THE INVENTION

1. Field of the Invention

The present invention relates to copy control apparatus for a copying machine and, more specifically, to a copy control apparatus for a copying machine in which copying conditions are stored in the memory and the copying conditions are set by calling the same.

2. Description of the Related Art

A copy control apparatus for a copying machine in which various copying conditions are stored as copy modes in memory means and various copying conditions are set by calling the stored copy modes has been known from, for example, Japanese Patent Laying-Open Gazette No. 222854/1984.

In a conventional copy control apparatus of this type, all of the necessary copying conditions for normal copying are stored as copy modes in the memory means. When a copy mode is called from the memory means, all the copying conditions are set and changed based on the called copy mode.

Now, the copying conditions stored as copy modes comprise the size of copy papers, copying magnification, copying density, the number of copies, and so on. Even if the copying magnification and the size of copy papers are to be especially set as the copying conditions and other copying conditions should preferably be set as needed when the copying machine is actually used, all the copying conditions had been stored as the copy modes in the conventional apparatus. Consequently, the condition of copying density or the number of copies, which is an unnecessary copying condition, was also stored. Consequently, if the copy mode is called, all the copying conditions including not only the copying magnification and the size of copy papers which should be set automatically but also the number of copies and the density of copying were set.

As a result, the following problems occur. Namely, when a number "1" is stored as the copy mode, an operator selects the number "10" when using the copying machine, and that copy mode is called after the selection, the copying magnification and the size of copy papers are set as expected, but the number of copies is changed from "10" to "1". Therefore the operator must set the number of copies again at "10".

As described above, in the conventional copy control apparatus, the operation was troublesome, and when the operator does not notice that the number of copies has been changed, miscopies are generated.

SUMMARY OF THE INVENTION

Therefore, one object of the present invention is to facilitate the operation of the copying apparatus.

Another object of the present invention is to prevent generation of unnecessary copies in the copying apparatus.

A further object of the present invention is to enable in a copying apparatus in which copying operation is carried out based on copying conditions stored in a memory, changes only of desired copying conditions out of the stored copying conditions.

A still further object of the present invention is to carry out operation under the copying conditions stored in the memory with some desired conditions for the desired items being arbitrarily set, in a copying machine carrying out copying operation under the copying conditions stored in the memory.

A still further object of the present invention is to facilitate setting of copying conditions and to eliminate errors in setting such conditions in a copying apparatus which carried out copying operation under copying conditions stored in the memory.

The above described objects of the present invention can be attained by a copying apparatus including a plurality of independent elements cooperating with each other to form images, comprising: an input apparatus for inputting copying conditions of a plurality of prescribed items necessary for determining an image forming mode; a first control apparatus operationally coupled to the input apparatus for controlling the plurality of elements to carry out image formation under the inputted copying conditions; a memory apparatus operationally coupled to the input apparatus for storing the plurality of copying conditions inputted by the inputting apparatus; a memory control apparatus connected to the input apparatus and to the memory device for storing those of the plurality of copying conditions for the prescribed items which are for desired items in the memory device; a calling apparatus connected to the memory device for calling the copying conditions for the desired items stored in the memory device; and a second control apparatus connected to the calling apparatus and the memory device for controlling the plurality of elements such that the image formation is carried out under the called conditions for the desired items and under the inputted conditions for the items other than the desired items.

Since the copying apparatus comprises the above described components, the image is formed with only the copying conditions for the desired items being changed out of the plurality of copying conditions. Therefore, unnecessary copying operation is not carried out even if the operator overlooks the set conditions. Consequently, troubles in operating the copying machine can be eliminated.

In accordance with a preferred embodiment of the present invention, a copying apparatus including a plurality of independent elements cooperating with each other to form images comprises: an input apparatus for inputting copying conditions for a plurality of items; a first copying condition setting apparatus connected to the input apparatus for collecting the setting of the copying conditions of the copying apparatus such that image formation is carried out under the inputted copying conditions; a memory connected to the input apparatus for storing the plurality of copying conditions inputted by the input apparatus; a memory mode setting apparatus connected to the input apparatus for setting a prescribed memory mode; a memory control apparatus for storing in the memory only the conditions of the changeable items inputted by said input apparatus when the memory mode is set; a calling apparatus connected to the memory for calling the plurality of conditions of the items stored in the memory; and a second copying condition setting apparatus connected to the calling apparatus and the first copying copying condition setting apparatus for resetting only those of the conditions set by the first copying condition setting apparatus which are for the called items.

In accordance with the preferred embodiment, the copying apparatus comprises the above described components. Therefore, only the conditions inputted when a prescribed mode is set are changed, and other conditions are kept as they are stored in the memory device. Consequently, a copying apparatus can be provided in which the copying operation is carried out under the conditions stored in the memory apparatus with some desired conditions for the desired items being arbitrarily changed.

In accordance with a more preferred embodiment of the present invention, the copying apparatus further comprises a copying condition displaying apparatus for displaying copying conditions of the plurality of items, and only the copying conditions of the items inputted by the input apparatus when the memory mode is set are displayed on the copying condition displaying apparatus.

Since the more preferred embodiment of the present invention comprises the above described components, the copying conditions of the inputted items are clearly displayed. Therefore, a copying apparatus can be provided in which the setting of copying condition can be easily carried out without errors.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 7 is a figure map showing how the flow charts of FIGS. 7A–7B fit together;

FIGS. 7A and 7B are flow charts of a mode call key processing routine;

DESCRIPTION OF THE PREFERRED EMBODIMENTS

The embodiments of the present invention will be described in the following with reference to the figures.

Figure 1:
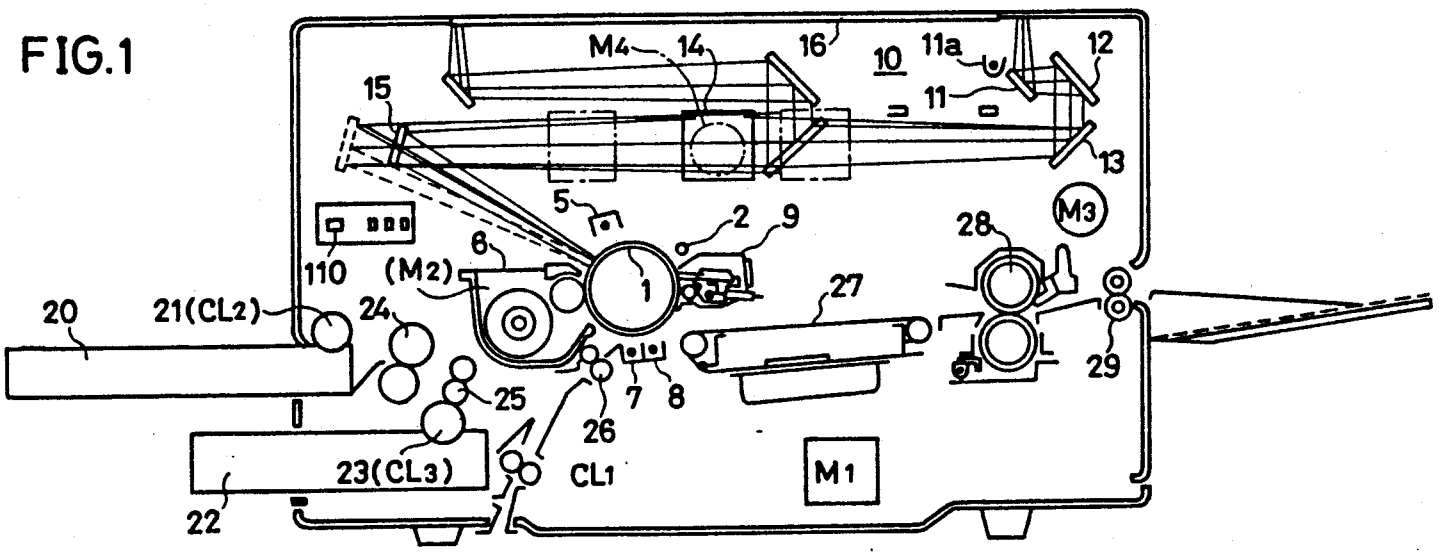
FIG. 1 is a cross sectional view showing a schematic structure of a copying machine in accordance with the present invention.

FIG. 1 is a cross sectional view showing a schematic structure of the copying machine. Referring to FIG. 1, the copying machine in accordance with the present invention comprises a photoreceptor drum 1 which can be rotary driven in a counterclockwise direction provided approximately at the center of the body of the copying machine, and an eraser lamp 2, a corona charger 5, a developing apparatus 6, a transfer charger 7, a separating charger 8 and a blade type cleaning apparatus 9 provided around the photoreceptor drum. The photoreceptor drum 1 comprises a photosensitive layer provided on the surface thereof. The surface is uniformly charged when the photoreceptor layer passes through the eraser lamp 2 and the corona charger 5 to receive image exposure on the photoreceptor drum through an optical system 10.

The optical system 10 is adapted to scan an original image below an original glass support 16 and the system comprises a light source 11*a*, movable mirrors 11, 12 and 13, a lens 14 and a mirror 15. The light source 11*a* and the movable mirrors 11, 12 and 13 are driven by a scan motor M3 such that the light source 11*a* and the movable mirror 11 move at a speed of v/n and the movable mirrors 12 and 13 move at a speed of v/2n where v represents a peripheral speed of the photoreceptor drum 1 and n represents a copying magnification.

On the left side of the body of the copying machine provided are an upper paper feeding portion 20 and a lower paper feeding portion 22 respectively comprising paper feeding rollers 21 and 23. A copy paper fed from either the upper or lower paper feeding portion is conveyed through a conveying path constituted by roller pairs 24, 25, a timing roller pair 26, a conveyer belt 27, a fixing apparatus 28 and a discharging roller pair 29 while the image of the photoreceptor drum 1 is transferred and fixed on the paper by the fixing apparatus 28.

Figure 2:
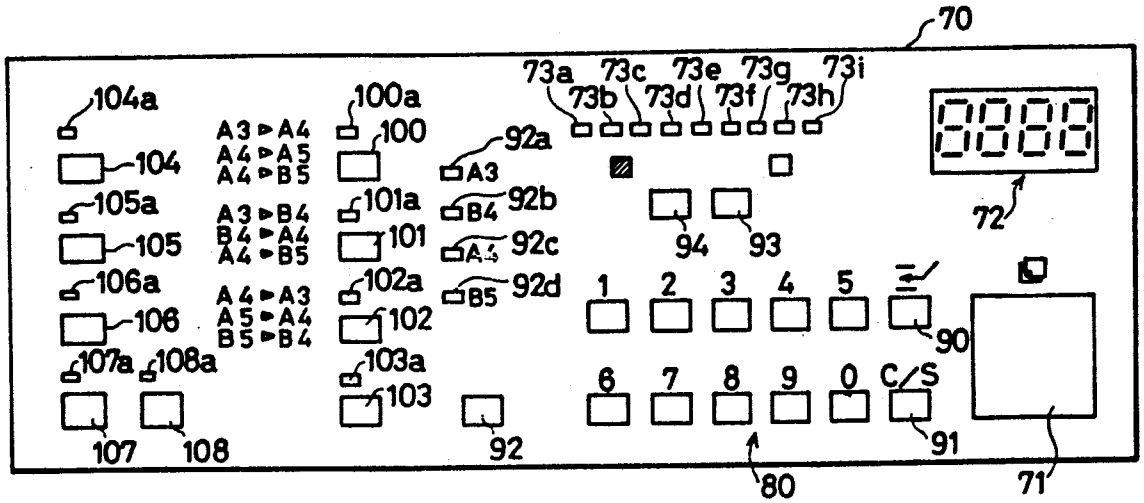
FIG. 2 is a plan view showing an operation panel.

FIG. 2 is a plan view of an operation panel 70 provided on the upper surface of the copying machine.

On the operation panel 70 provided are a print start key 71 for starting the copying operation; a display portion 72 comprising 7 segment LEDs and the like for displaying information of the number of copies and the like; ten keys 80 comprising ten numeral keys from 0 to 9 for inputting the number of copies and the like; an interruption key 90 for designating an interrupting copying operation; a clear stop key 91; a paper selection key 92 for designating a paper feed cassette to be employed; paper display portions 92*a* to 92*d* for displaying the size of copy papers contained in the selected cassette; an up key 93 and a down key 94 for changing and setting stepwise the copy image density; density display portions 73*a* to 73*i* for displaying the set density; magnification setting keys 100 to 103 for setting copying magnification; magnification display portions 100*a* to 103*a* for displaying the set magnification; program call keys 104 to 107 for selecting one of a plurality of copy programs for storing and loading the same; program displaying portions 104*a* to 107*a* for displaying respective programs; a switching key 108 for switching to a setting mode for setting programs; and a setting mode displaying portion 108*a* displaying the operation being in the setting mode.

Figure 3:
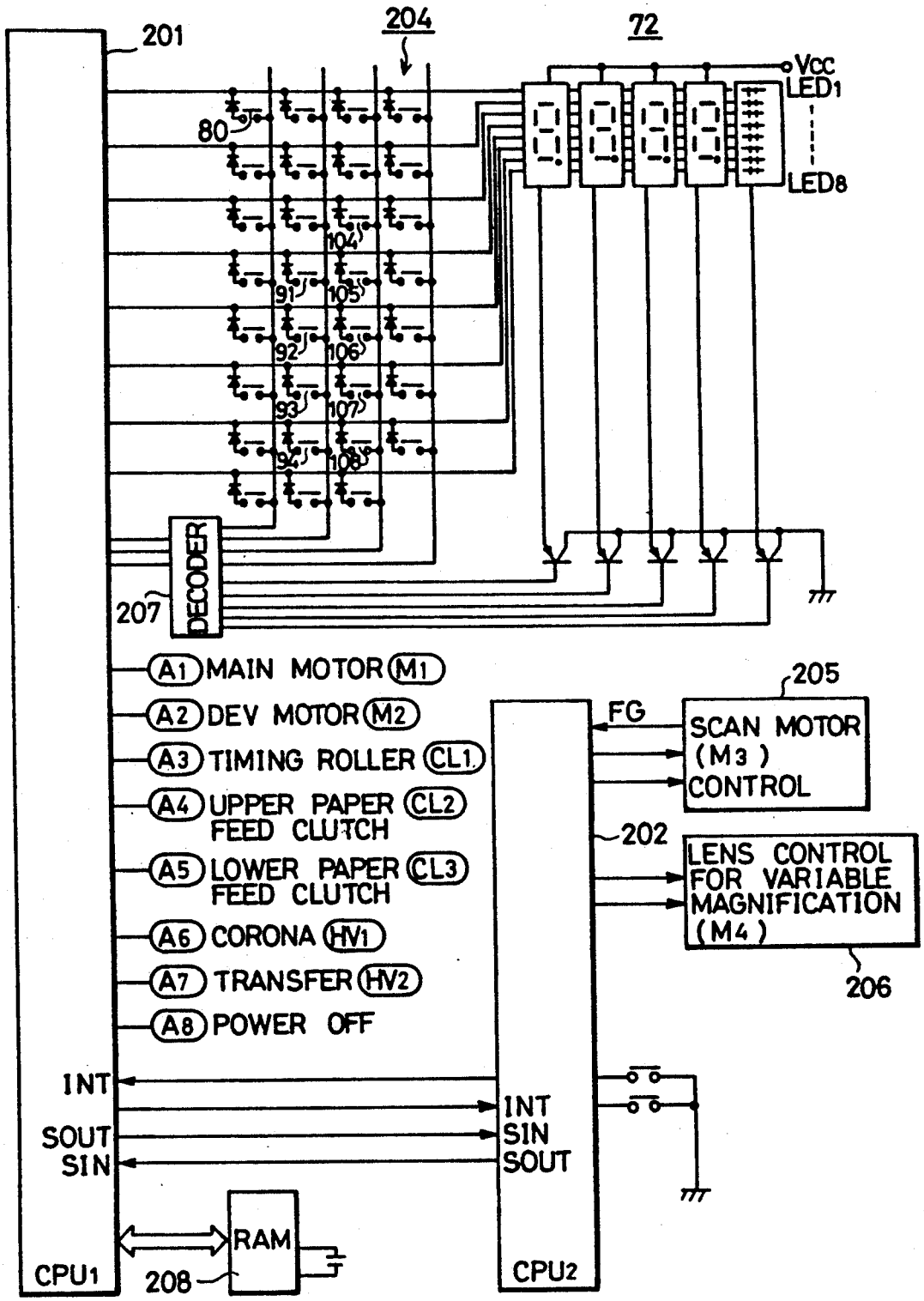
FIG. 3 is a schematic diagram showing a control circuit of the copying machine.

FIG. 3 is a schematic diagram showing the control circuit of the copying machine. The control circuit of the copying machine comprises a first CPU (Central Processing Unit) 201 formed of microcomputers, a second CPU 202, a switch matrix 204 including keys on the operation panel and the like, a driving circuit 205 for driving the scan motor M3, a driving circuit 206 for driving a stepping motor M4 for moving a lens 14 for variable scale magnification; a recorder 207 and an RAM 208 for storing various information such as copy programs and the like.

Various copying conditions set by the ten keys 80, paper selection key 92, up key 93, the down key 94 and the magnification setting keys 100 to 103 are stored in the RAM 208 as copy programs. The RAM 208 comprise program memories 1 to 4 which are memory regions corresponding to the program call keys 104 to 107, which memories are backed up by a battery so that the contents thereof are maintained even if the power is turned off.

When a copy program is to be stored in the RAM 208, at first a switching key 108 is placed to start the setting mode. Thereafter, the copying conditions to be set are set by means of the above described keys, and one of the program call keys 104 to 107 is pressed. A setting mode displaying portion 108*a* is on during the setting mode. Immediately after the setting mode is started by pressing the switching key 108, all displays on the operation panel 70 for displaying copying conditions are turned off, and no copying condition is stored even if the program call keys 104 to 107 are pressed. When the above described respective keys are pressed in this state, the copying conditions to be stored as copy programs are set, and only the set copying conditions are displayed on the operation panel 70.

When a copy program stored in the RAM 208 is to be called , any of the program call keys 104 to 107 should be pressed when the set mode displaying portion 108*a* is off, that is, when the copying machine is not in the setting mode. On that occasion, the copying conditions included in the copy program stored in any of the program memory 1 to 4 are loaded to the register of the first CPU 201, and the second CPU 202 or other working areas in the RAM, thereby setting various copying conditions for the copying operation.

On this occasion, only the copying conditions included in the called copy program can be set and the copying conditions which are not included in the copy program can not be changed. Namely, out of the copying conditions which have been set before the program call key is pressed, the copying conditions included in the copy program are changed but the copying conditions which are not included in the copy program are maintained as they were before the pressing of the program call key.

Meanwhile output terminals A1 to A8 are connected to transistors for switching driving of motors, roller clutches and chargers.

The procedure of the copying operation in the first CPU 201 will be described in the following with reference to the flow charts of FIGS. 4 to 8A and 8B.

Figure 4:
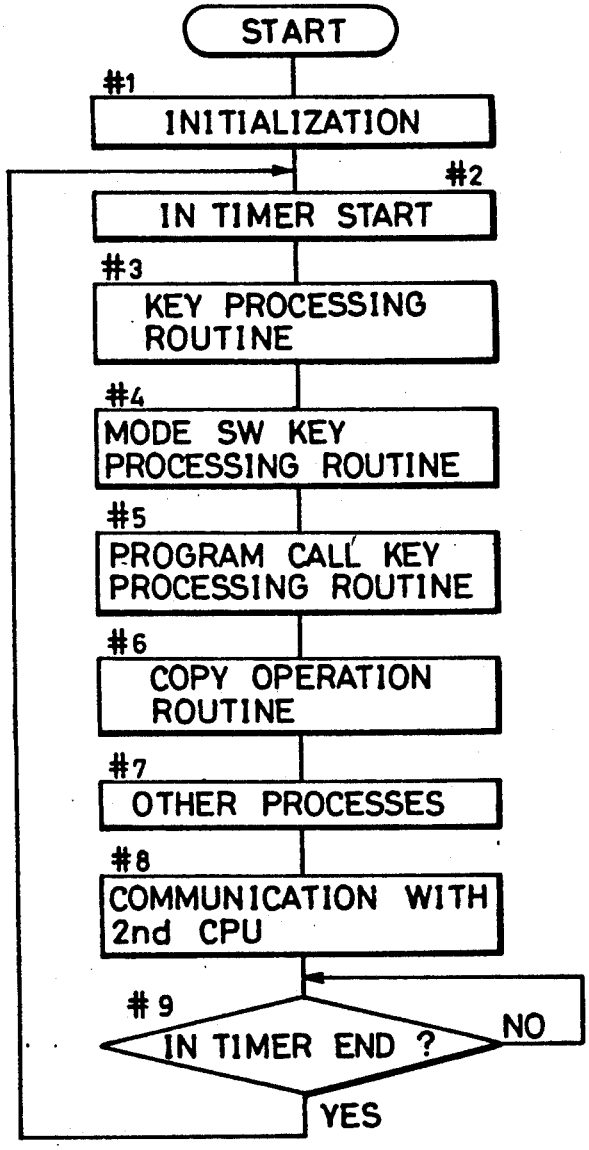
FIG. 4 is a flow chart schematically showing a main flow of the process of a first CPU.

FIG. 4 is a flow chart schematically showing the main flow of the process of the first CPU 201.

When the power is turned on and the program is started, initialization is carried out in the step #1 in which the RAM is cleared, various registers are initialized, the first and second CPUs 201 and 202 are initialized and the copying machine is brought into an initial mode. Now, the term initial mode means a collection of copying conditions which are frequently used, for example the number of copies is "1", the density level is intermediate and the copying magnification is the equal scale magnification, and so on.

In the step #2, an internal timer is set for defining a length of 1 routine.

The key processing routine, the mode switching key processing routine, the mode call key processing routine, the copying operation routine and other processing routines are successively carried out (steps #3 to #7). Thereafter, data communication with the second CPU is carried out (step #8).

After these processes, the end of operation of the set internal timer is waited in the step #9. This is to make constant the length of 1 routine.

Figure 5:
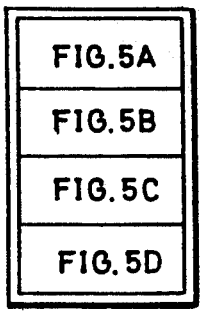
FIG. 5 is a figure map showing how the flow charts of FIGS. 5A–5D fit together.
Figure 5A:
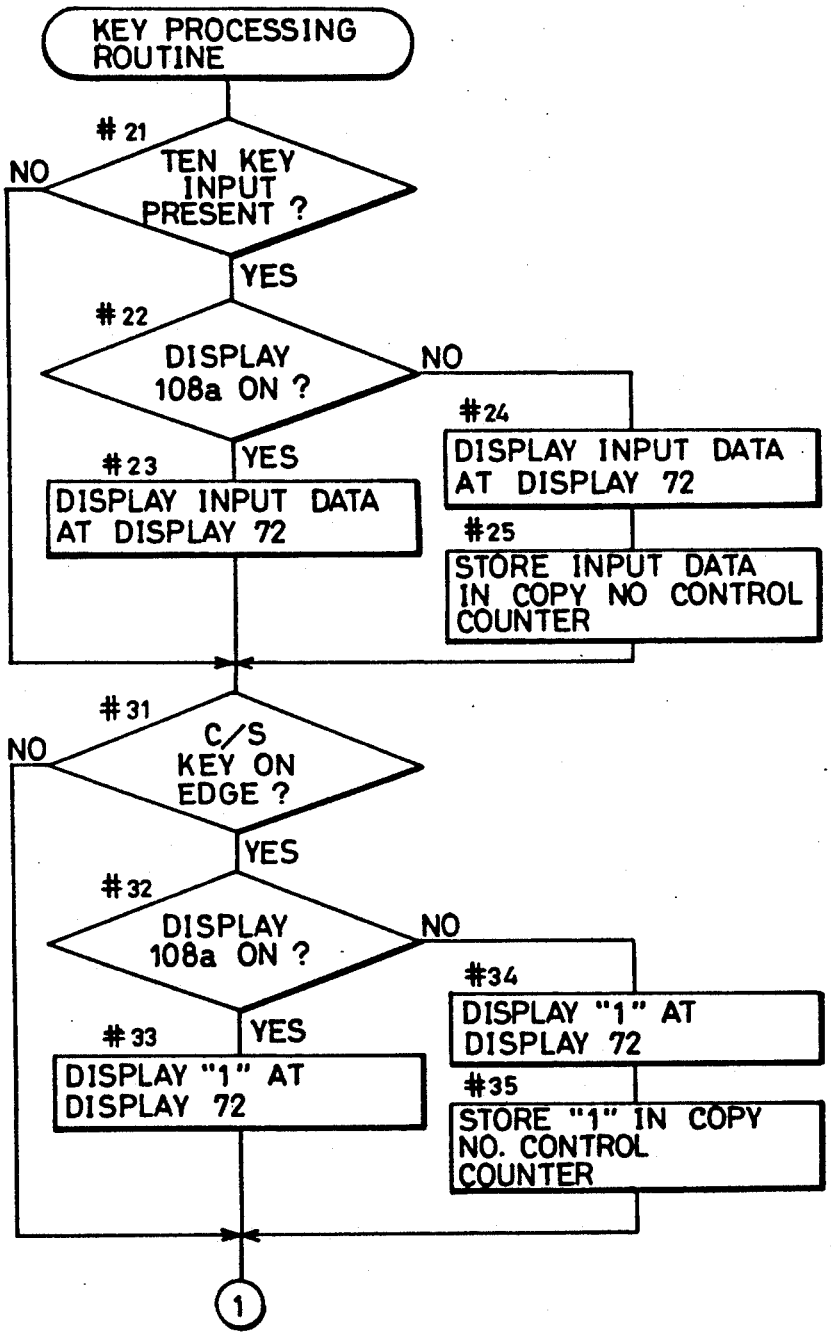
FIGS. 5A to 5D are flow charts of key processing routine.

FIG. 5 is a flow chart of the above described key processing routine in the step #3.

In the step #21, whether there is an input from the ten keys 80 or not is determined, and if there is an input, whether the setting mode displaying portion 108*a* is turned on or not, that is, whether it is in the setting mode or not is determined in the step #22.

If it is in the setting mode (YES in the step #22), the input data from the ten keys 80, namely the number of copies, is displayed on the displaying portion 72 (step #23).

If it is not in the setting mode (NO in the step #22), the input data from the ten keys 80 is displayed on the displaying portion 72 (step #24) and, at the same time, the input data is stored in a counter for controlling the number of copies (step #25). The number of copies for the copying operation is set in the step #25.

In the step #31, whether the clearstop key 91 is pressed or not is determined, and if it is pressed, whether it is in the setting mode or not is determined in the step #32.

If it is in the setting mode, "1" is displayed on the displaying portion 72 (step #33).

If it is not in the setting mode, "1" is displayed on the displaying portion 72 (step #34) and "1" is stored in the counter for controlling the number of copies (step #35).

Figure 5B:
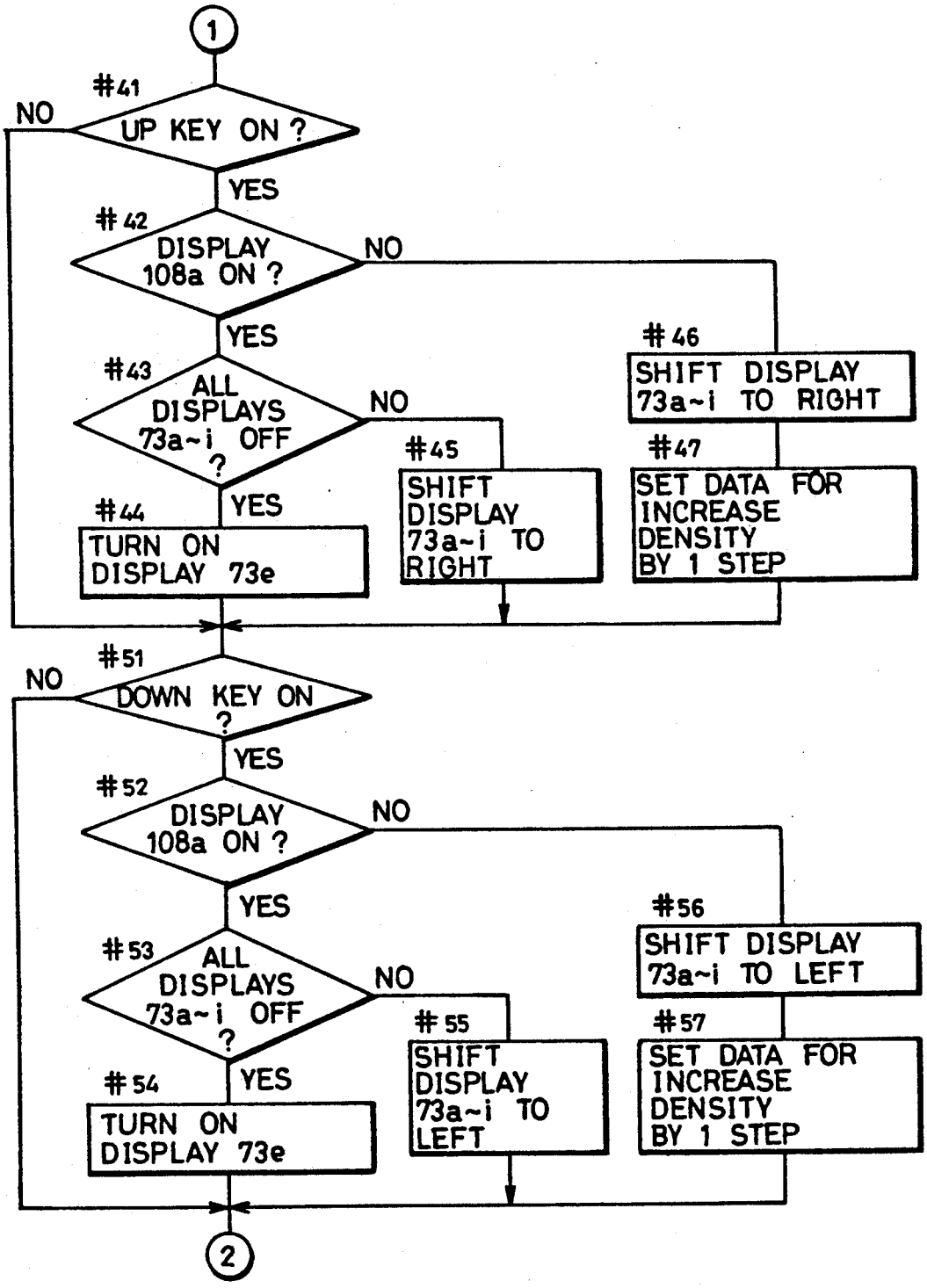

Referring to FIG. 5B, whether the up key 93 is pressed or not is determined in the step #41, and if it is pressed, whether it is in the setting mode or not is determined in the step #42.

If it is in the setting mode, whether all the density displaying portions 73*a* to *i* are off or not is determined (step #43). If so, only the central density displaying portion 73*e* of the density displaying portions 73*a* to *i* is turned on (step #44), and if not, the display on any one of the density displaying portions 73*a* to *i* is shifted up by one in the right (step #45).

If it is not in the setting mode, the display on any one of the density displaying portions 73*a* to *i* is shifted up by one in the right (step #46), and data for stepping up the density by 1 in the copying operation is set (step #47). The limit of shifting is the density displaying portion 73 i at the right end.

In the step #51, whether the down key 94 is pressed or not is determined, and if so, whether it is in the setting mode or not is determined in the step #52.

If it is in the setting mode, whether all the density displaying portions 73*a* to *i* are off or not is determined (step #53). If all density displaying portions are off, only the density displaying portion 73*e* at the center of the density displaying portions 73*a* to *i* is turned on (step #54), and if not, the display on any one of the density displaying portions 73*a* to *i* is shifted down by one in the left (step #55).

If it is not in the setting mode, the display on any one of the density displaying portions 73 a to i is shifted down by one in the left (step #56), and the data for stepping down the density by one in the copying operation is set (step #57). The limit of the shifting down is the density displaying portion 73*a* at the left end.

Figure 5C:
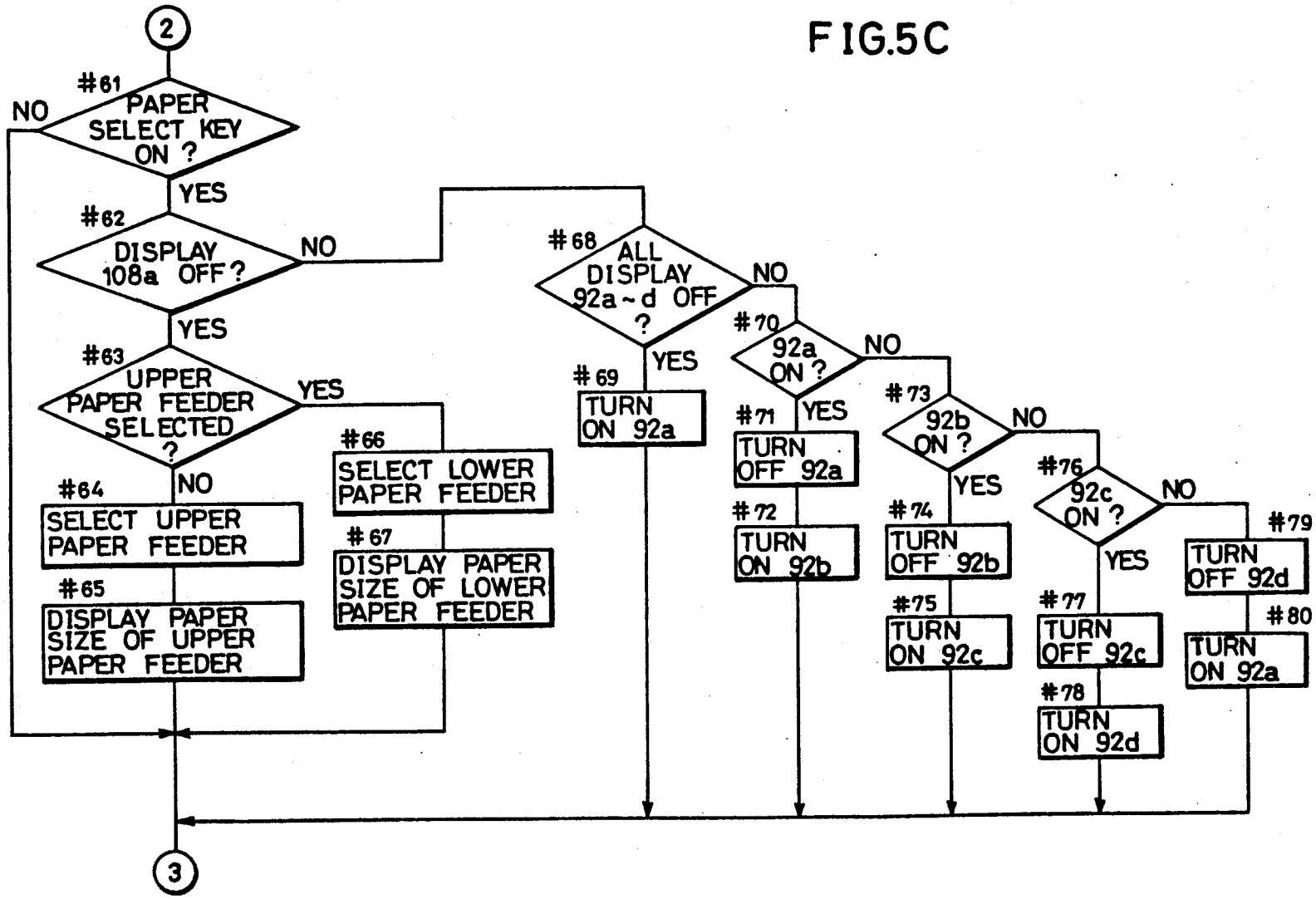
Figure 5D:
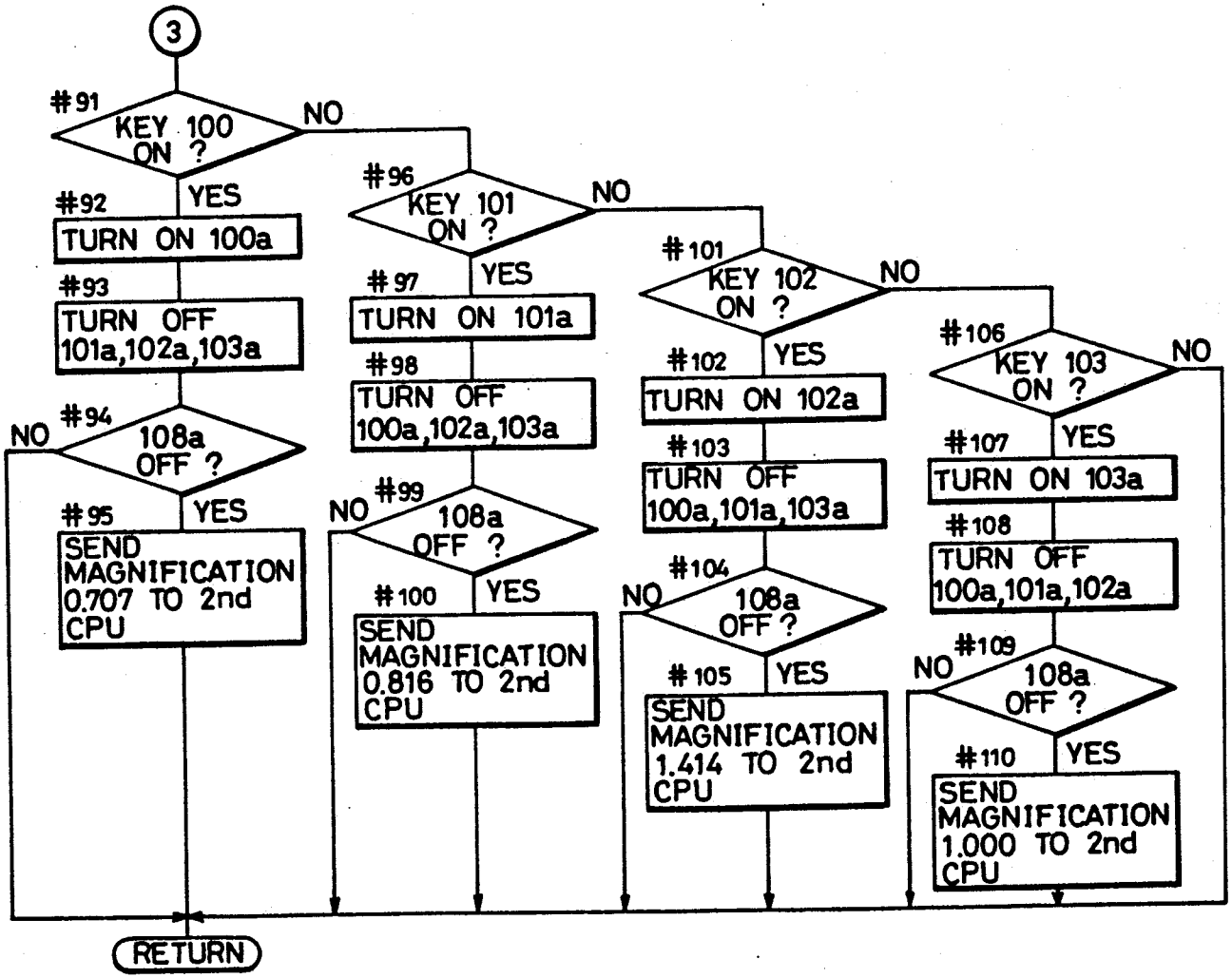

Referring to FIG. 5C, whether the paper selection key 92 is pressed or not is determined in the step #51. If it is pressed, whether the setting mode displaying portion 108A is off or not, that is, whether it is in the setting mode or not is determined in the step #62.

If it is not in the setting mode (YES in the step #62), and if the upper paper feeding portion 20 has been selected, then the lower paper feeding portion 22 is selected. If the lower paper feeding portion 22 has been selected, then the upper paper feeding portion 20 is selected. The size of copy papers in the paper feeding portion which is to be selected is displayed on the paper displaying portions 92*a* to *d* (steps #63 to #67).

If it is in the setting mode, and when all of the paper displaying portions 92*a* to *d* are off, then a paper displaying portion 92*a* indicating the largest size of copy paper is turned on (steps #68 and #69). When any one of the paper displaying portions 92*a* to *d* is on, then the light on the paper displaying portions 92*a* to 92*d* is shifted in the order of 92*a*→92*b*→92*c*→92*d*→92*a*. . . (steps #70 to 80).

In the step #91, whether the magnification setting key 100 is pressed or not is determined. If the magnification setting key 100 is pressed, the magnification displaying portion 100*a* is turned on (step #92), and other magnification displaying portions 101*a* to 103*a* are turned off (step #93). Thereafter, whether it is in the setting mode or not is determined (step #94). If it is not in the setting mode, a magnification data of 0.707 is transmitted to the second CPU 202 (step #95).

In the similar manner, whether each of the magnification setting keys 101 to 103 is pressed or not is determined. When the key is pressed, the corresponding magnification displaying portion out of the portions 101*a* to 103*a* is turned on, and if it is not in the setting mode, the respective magnification data is transmitted to the second CPU 202 (steps #96 to #110).

Figure 6:
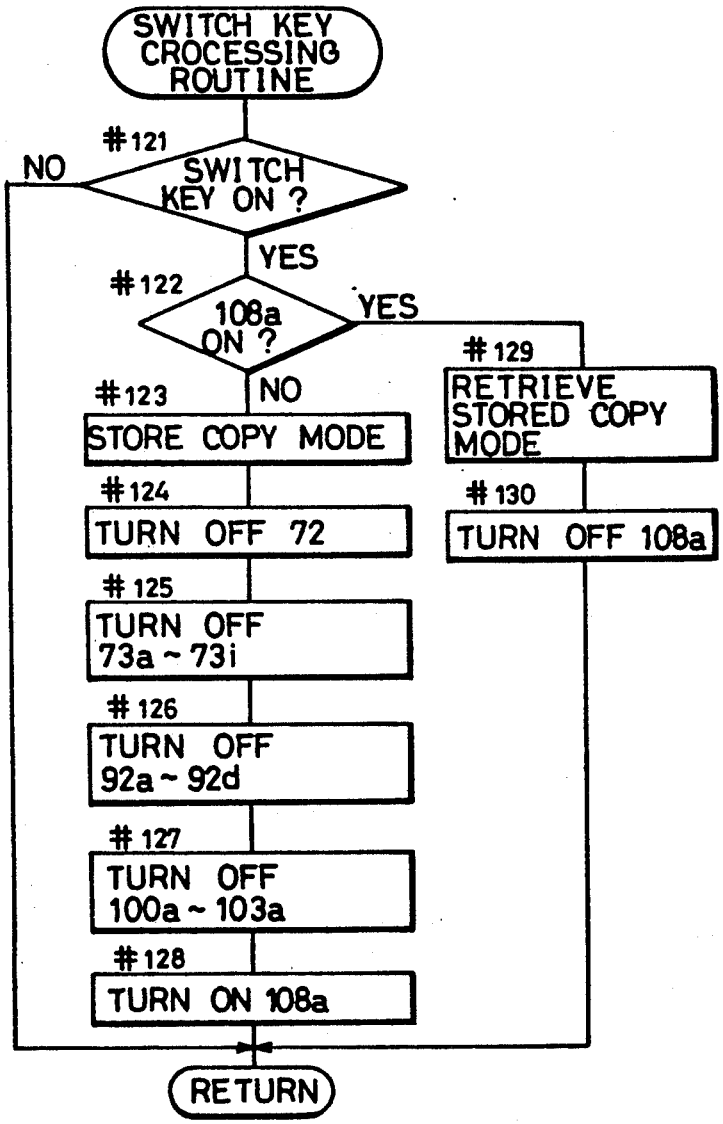
FIG. 6 is a flow chart of a mode switching key processing routine.

FIG. 6 is a flow chart of the above described switching key processing routine in the step #4.

In the step #121, whether the switching key 108 has been pressed or not is determined. If the switching key has been pressed, then, whether the setting mode displaying portion 108*a* is on or not, namely, whether it is in the setting mode or not, is determined (step #122). If it is in the setting mode, the mode is cancelled. If it is not in the setting mode, processes are carried out to switch to the setting mode (steps #123 to #130).

More specifically, if it is not in the setting mode (NO in the step #122), all the copying conditions in association with the copying mode are stored in an appropriate region of the RAM 208 (step #123). Thereafter, the displaying portion 72, the density displaying portions 73*a* to 73*i*, paper displaying portions 92*a* to 92*d* and the magnification displaying portions 100*a* to 103*a* are all turned off (steps #124 to #127), and the setting mode displaying portion 108*a* is turned on (step #128). Consequently, the processing mode of the copying machine is switched to the setting mode, the displaying portions in association with the copying conditions on the operation panel 70 are all turned off, and there is no copying condition set for the copying mode.

If it is in the setting mode (YES in the step #122), the copying conditions stored in the RAM 208 before entering the setting mode are returned (step #129) and the setting mode displaying portion 108*a* is turned off (step #130). Consequently, the setting mode is cancelled, and the copying conditions which are set before entering the setting mode are set again.

Figure 7B:
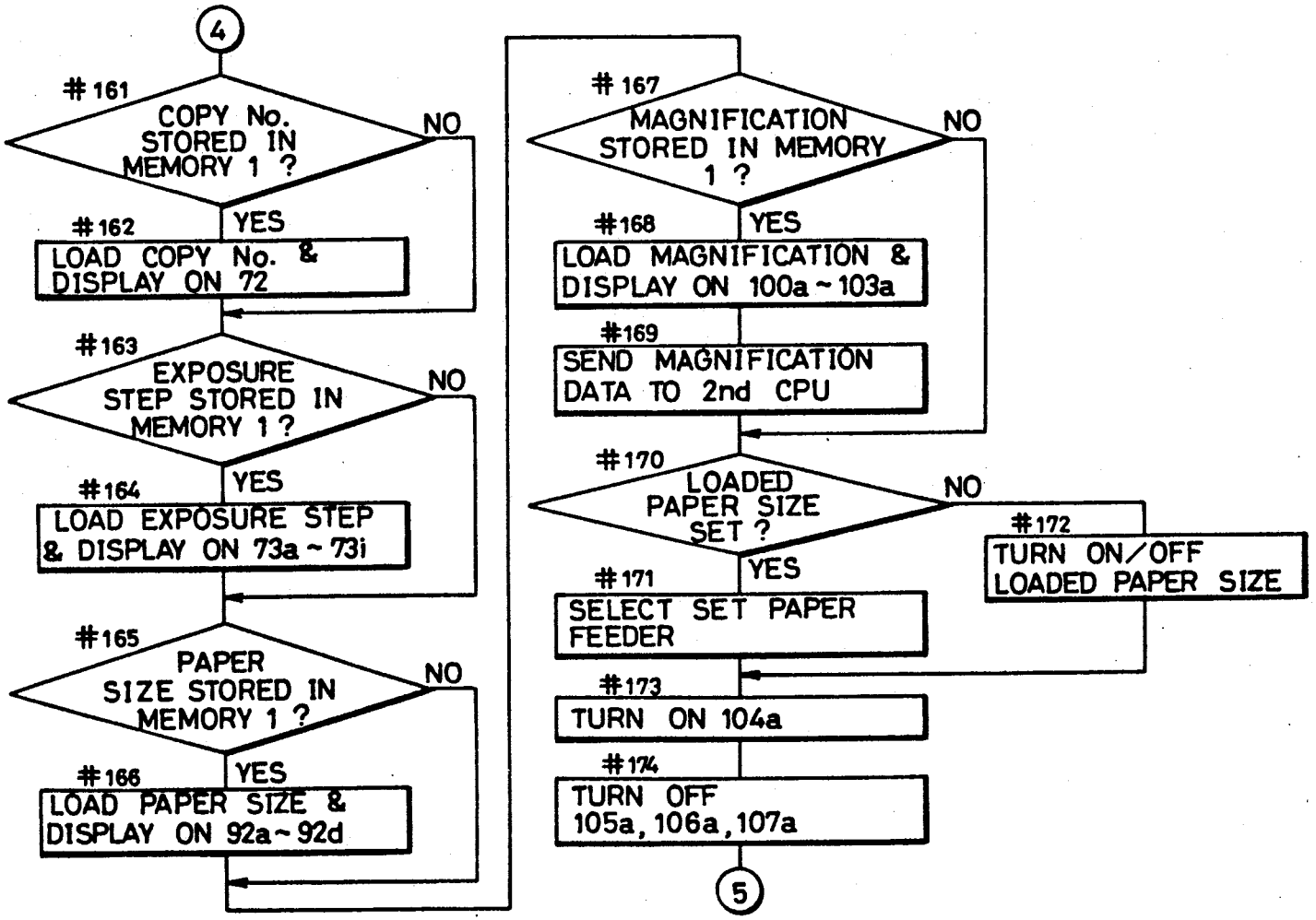

FIG. 7A is a flow chart of the above described program call key processing routine in the step #5.

In this routine, any one of the four program call keys 104 to 107 is pressed to store or load copy program to the corresponding one of the program memories 1 to 4 in the RAM 208. Since the process following the pressing of any of the program call keys 104 to 107 are the same, only the presses when one program call key 104 is pressed is shown in the flow chart.

In the step #141, whether the program call key 104 is pressed or not is determined.

If the copy program displaying portion 104*a* is on (NO in the step #142) at that time, the portion 104*a* is turned off (step #181), and each of the copying conditions is set at the initial mode (step #182).

If the copy program displaying portion 104*a* is off, whether the setting mode displaying portion 108 is turned off or not is determined (step #143). If it is turned on, the processes following the step #144 for storing the copy mode are carried out. If it is off, the processes following the step #161 for loading the copy program are carried out.

Respective copying conditions are stored in the steps following the step #144. More specifically, if each of the displaying portion 72, the density displaying portions 73*a* to 73*i*, paper displaying portions 92*a* to 92*d* and the magnification displaying portions 100*a* to 103*a* is on (YES in the steps #144, 146, 148 and 150, respectively), the respective copying conditions are stored in the program memory 1 (steps #145, 147, 149 and 151). Thereafter, the setting mode displaying portion 108*a* is turned off (step #152) and the setting mode is cancelled.

After the step #161, the respective copying conditions are loaded to the registers and to the working area of the RAM, whereby various copying conditions for the copying operation are set.

More specifically, when the number of copies, the exposure step, the size of copy papers and the magnification rate are stored in the program memory 1 (YES in the steps #161, 163, 165 and 167, respectively), the respective copying conditions are loaded. At the same time, the copying conditions are respectively displayed on the displaying portion 72, corresponding one of the density displaying portion 73*a* to *i*, corresponding one of the paper displaying portions 92*a* to 92*d* and corresponding one of the magnification displaying portions 100*a* to 103*a* (steps #162, 164, 166 and 168).

In the step #169, the loaded data of the magnification is transmitted to the second CPU 202.

In the step #170, whether papers of the loaded size are set or not in the upper or lower paper feeding portion 20 or 22 is determined. If papers of the loaded size are set, the paper feeding portion containing the paper is selected (step #171). If not, one of the paper displaying portions 92*a* to *d* corresponding to the loaded size flickers (step #172).

Thereafter, the copy mode displaying portion 104*a* is turned on (step #173) and other copy mode displaying portions 105*a* to 107*a* are turned off (step #174).

Whether the program call keys 105, 106 and 107 are pressed or not are determined in the steps #191, 192 and 193, respectively. If the program call key is pressed, the same operation as in the case when the program call key 104 is pressed is carried out.

Figure 8:
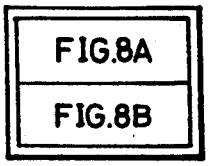
FIG. 8 is a figure map showing how the flow charts of FIGS. 8A–8B fit together.
Figure 8A:
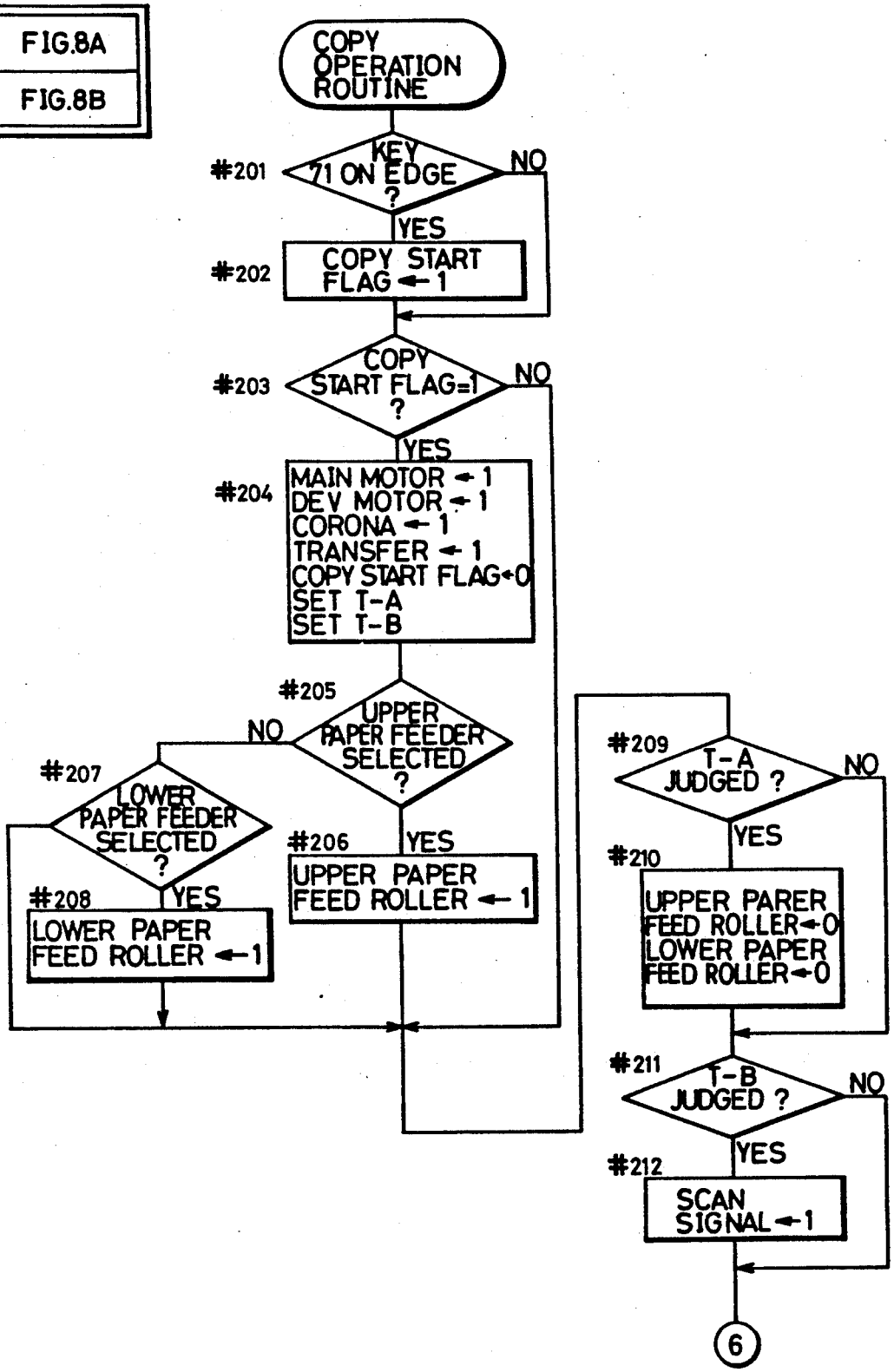
FIGS. 8A and 8B are flow charts of a copying operation routine.
Figure 8B:
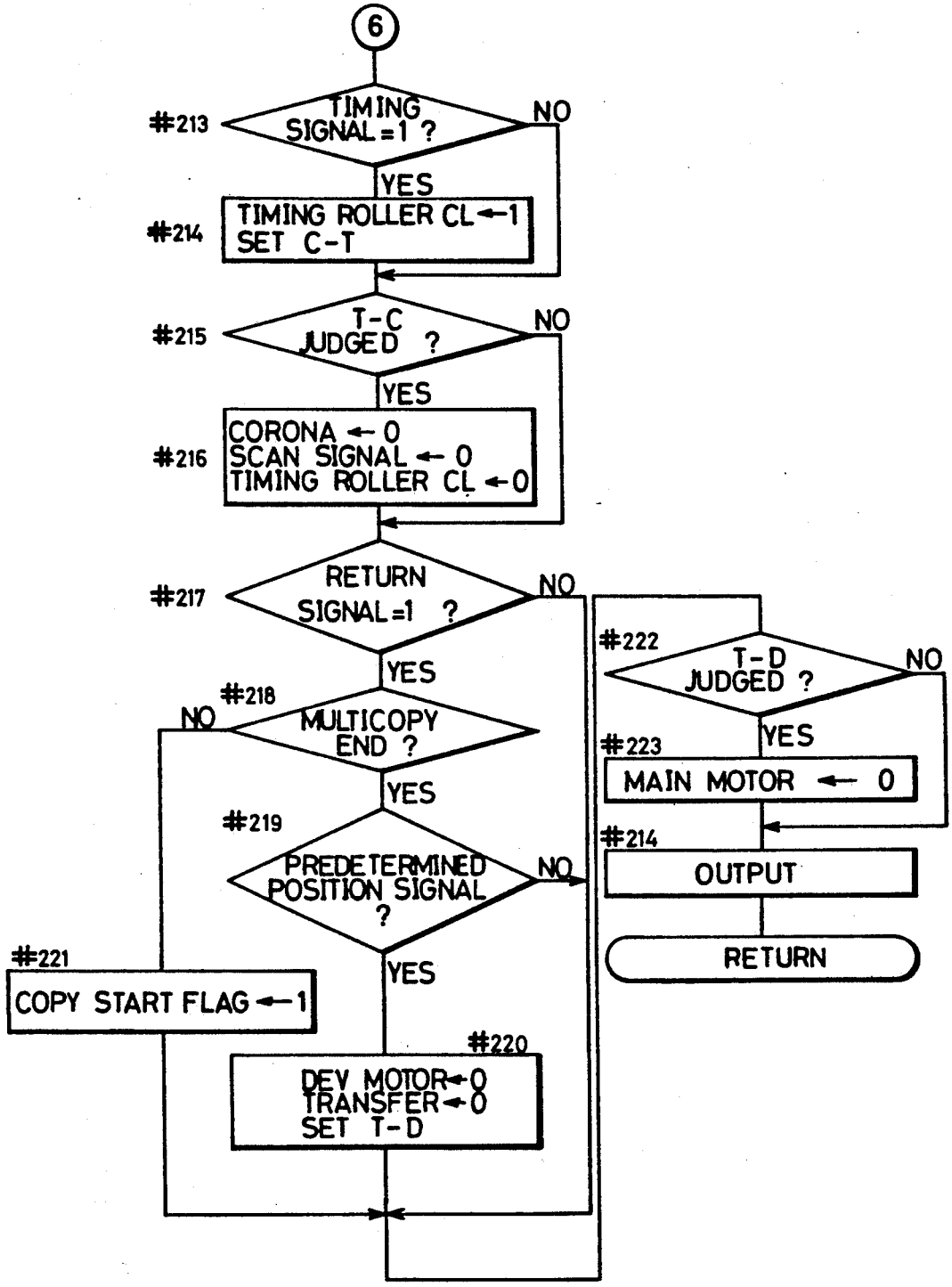

FIG. 8 is a flow chart showing the above described copy operation routine in the step #6.

If a print start key 71 is pressed, a copy start flag is set at "1" (steps #201, 202). Then, the main motor M1 driving the photoreceptor drum 1, the developing motor M2, corona chargers 3 and 5 and the transfer charger 7 are respectively activated. The copy start flag is set at "1", the timers T-A and T-B for control are started, and the clutch of a paper feeding roller at the selected one of the upper and lower paper feeding portions 20 and 22 is turned on (steps #203 to 208).

Thereafter, the paper feeding clutch is turned off when the end of the operation of the timer T-A is detected (steps #109 and 210). When the end of operation of the timer T-B is detected, the scan motor M3 for driving the scanning optical system 10 is turned on to carry out the scanning operation (steps #211 and 212). A scanning operation timing switch, not shown, is activated to output timing signals, and the clutch of the timing roller pair 26 is turned on. At the same time, the timer T-C is set (steps #213 and 214). By means of the timing roller pair 26, the copy paper is conveyed in synchronization with the image on the photoreceptor drum 1.

When the end of operation of the timer T-C is detected, the corona chargers 3 and 5, the scan motor M3 and the timing roller clutch are turned off (steps 215 and 216).

When a predetermined position switch is turned on indicating that the optical system 10, not shown, is at the initial position in association with the returning operation of the optical system 10, the developing motor M2 and the transfer charger 7 are turned off, and a timer T-D is set. If multiple copying is not completed, the copy start flag is set at "1" (Steps #217 to 220).

Thereafter, the end of the operation of the timer T-D is detected, the main motor Ml is turned off and processes for providing various outputs are carried out (steps #222 to 224).

The timers T-A to T-D are digital timers programmed to be incremented one by one in 1 routine of the process carried out in a time period defined by the internal timer.

In accordance with the above described embodiments, when any one of the program call keys 104 to 107 is pressed under the setting mode, the copying conditions set at that time are stored in one of the corresponding program memories 1 to 4 of the RAM 208 as the copy program. When any one of the program call keys 104 to 107 is pressed when the setting mode is not set, the copy program stored in corresponding one of the program memories 1 to 4 is loaded, and the setting can be changed only by the copying conditions included in the copy program. As for the copying conditions which are not included in the copy program, they are maintained at the same set states before any of the program call keys 104 to 107 are pressed.

Therefore, there is no possibility of setting unnecessary copying conditions when the copy program is called. Consequently, the troubles in operating conventional copying control apparatuses can be eliminated, and the miscopies can be prevented even if the changes of copying conditions are overlooked.

When the switching key 108 is pressed, the copying mode can be switched to the setting mode. In the setting mode, the displaying portions in association with the copying conditions on the operation panel 70 are turned off and thereafter, only the copying conditions set by respective keys are displayed, whereby the setting of the copying conditions for the copying program can be carried out in a simple manner without errors.

In the above described embodiment, the copying conditions are stored to the program memories 1 to 4 and the copying conditions are loaded from the program memories 1 to 4 by means of the program call keys 104 to 107. The keys for storing and loading may be separately provided. In the above described embodiment, four program call keys 104 to 107 are provided corresponding to four program memories 1 to 4. However, only one program call key may be provided and the program memories 1 to 4 may be rotated every time the program call key is pressed, enabling the selection of any of the program memories. Alternatively, one program call key may be provided and the copy program of any of the program memories 1 to 4 selected by the key is loaded when the copying mode is not the setting mode, and when any of the program memories 1 to 4 is selected, the mode may be switched to the setting mode by pressing the switching key 108. The copy program may be stored in any of the program memories 1 to 4 when the program call key is pressed in the setting mode.

Although four copy programs are to be stored in the above described embodiment, five or more, or three or less copy programs may be stored. Other copying conditions may be included in the copy programs.

According to the present invention, when a copy program is called from a memory by means of a calling apparatus such as a program call key, only the copying conditions included in the copy program are newly set and other copying conditions which are not included in the copy program are maintained as they are. Therefore, there is no possibility of setting unnecessary copying conditions when the copy program is called, whereby the troubles in operating the copying apparatus can be eliminated, and the miscopies are prevented even if the changes of copying conditions are overlooked.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A copying apparatus including a plurality of independent elements cooperating with each other to form an image, comprising:

input means for inputting copying conditions of a plurality of prescribed items necessary for determining an image forming node;

first control next for controlling said plurality of elements such that image formation is carried out under said inputted copying conditions;

memory means;

memory control means for storing in said memory means those of said plurality of copying conditions for any combination of the prescribed items which are desired items;

calling means for calling said copying conditions of the desired items stored in said memory means; and second control means for controlling said plurality of elements such that image formation is carried out under said called conditions for said desired items and under said inputted conditions for the prescribed items other than said desired items, whereby image formation is carried out under said inputted copying conditions for each carrying out of image formation under said called condition.

2. A copying apparatus including a plurality of independent elements cooperating with each other to form an image, comprising:

input means for inputting copying conditions for a plurality of items;

first copying operation setting means for setting copying conditions of said copying apparatus for carrying out said formation under said inputted copying conditions;

memory means;

memory mode setting means for setting a prescribed memory mode;

memory control apparatus for storing in said memory means any combination of the copying conditions for said plurality of items inputted by said input means when said memory mode is set;

calling means for calling the copying conditions of the items stored in said memory means; and second copying conditions setting means for resetting only the conditions of the items stored in said memory means and called by the calling means out of the conditions set by said first copying conditions setting means.

3. A copying apparatus according to claim 2, further comprising:

copying condition displaying means for displaying copying conditions of said plurality of items, wherein only the copying conditions of the items inputted by said input means when said memory mode is set are displayed on said copying condition displaying means.

4. A copying apparatus including a plurality of dependent elements cooperating with each other to form an image, comprising:

input means for entering copying conditions of a plurality of prescribed items necessary for determining an image forming mode;

first means for controlling said plurality of dependent elements such that image formation is carried out under the copying conditions entered by said input means;

a memory;

memory control means for storing in said memory copying conditions for any combination of the items that are desired;

means for determining whether each item of the copying conditions are stored in the memory;

calling means for calling copying conditions for the items determined to be stored in said memory; and second means for controlling said plurality of dependent elements such that image formation is carried out under the called copying conditions for the desired ones of the items and under set entered copying conditions for the items other than said desired ones, whereby said set entered copying conditions remain set for each carrying out of image formation under the called copying conditions.

5. A method for setting copying conditions for selectable items in a copy apparatus having a memory for storing the copying conditions for any combination of the selectable items and a keyboard for entering the copying conditions, comprising the steps of:

entering said copying conditions;

calling the contents of said memory;

determining whether each item of said copying conditions has been called from said memory; and setting copying conditions such that image formation is carried out under the called copying conditions for items stored in the memory and under entered copying conditions for the items other than stored items, whereby image formation is carried out under said entered copying conditions for each carrying out of image formation under the called conditions.

* * * * *